US008616676B2

(12) United States Patent
Hagiwara

(10) Patent No.: US 8,616,676 B2
(45) Date of Patent: Dec. 31, 2013

(54) LIQUID EJECTING HEAD UNIT, MANUFACTURING METHOD FOR A LIQUID EJECTING HEAD UNIT, AND LIQUID EJECTING APPARATUS

(75) Inventor: Hiroyuki Hagiwara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 239 days.

(21) Appl. No.: 13/159,220

(22) Filed: Jun. 13, 2011

(65) Prior Publication Data

US 2012/0007922 A1 Jan. 12, 2012

(30) Foreign Application Priority Data

Jul. 7, 2010 (JP) ..... 2010-154733

(51) Int. Cl.
*B41J 2/015* (2006.01)

(52) U.S. Cl.
USPC ..... 347/20; 347/54; 347/86

(58) Field of Classification Search
USPC ..... 347/12, 13, 20, 40, 42, 44, 47, 49, 54, 347/84–87
See application file for complete search history.

(56) References Cited

U.S. PATENT DOCUMENTS 7,328,965 B2 * 2/2008 Owaki ..... 347/20

FOREIGN PATENT DOCUMENTS

JP 2008273109 F1 11/2008

* cited by examiner

*Primary Examiner* — Juanita D Jackson
(74) *Attorney, Agent, or Firm* — Workman Nydegger

(57) ABSTRACT

A sub-carriage includes a housing unit that houses at least part of each of multiple recording heads, and a head passage opening and an upper opening serving as opening portions through which the housing unit passes. A flow channel anchoring member for anchoring a flow channel member is attached to the sub-carriage so as to span across the aforementioned opening portions, and each of the recording heads is sequentially anchored to the sub-carriage to which the flow channel anchoring member has been attached.

6 Claims, 14 Drawing Sheets

LIQUID EJECTING HEAD UNIT, MANUFACTURING METHOD FOR A LIQUID EJECTING HEAD UNIT, AND LIQUID EJECTING APPARATUS

The entire disclosure of Japanese Patent Application No: 2010-154733, filed Jul. 7, 2010 are expressly incorporated by reference herein.

BACKGROUND

1. Technical Field

The present invention relates to liquid ejecting head units used in liquid ejecting apparatuses such as ink jet recording apparatuses, manufacturing methods for liquid ejecting head units, and liquid ejecting apparatuses, and particularly relates to liquid ejecting head units, manufacturing methods for liquid ejecting head units, and liquid ejecting apparatuses in which multiple liquid ejecting heads can be attached with high positional precision.

2. Related Art

A liquid ejecting apparatus is an apparatus that includes a liquid ejecting head capable of ejecting a liquid as droplets, and that ejects various types of liquid from this liquid ejecting head. An image recording apparatus such as an ink jet recording apparatus (a printer) that includes an ink jet recording head (called simply a "recording head" hereinafter) and carries out recording by ejecting ink in liquid form through nozzles in the recording head as ink droplets can be given as a typical example of such a liquid ejecting apparatus. Meanwhile, in recent years, liquid ejecting apparatuses are being used in various types of manufacturing apparatuses such as display manufacturing apparatuses in addition to such image recording apparatuses.

In recent years, some such printers employ configurations in which multiple recording heads, each having a nozzle group made up of multiple nozzles arranged in rows, are arranged in and affixed to a head anchoring member such as a sub-carriage, thus configuring a single head unit (for example, see JP-A-2008-273109). This sub-carriage is a frame-shaped and flat plane-shaped member having openings provided in the areas in which the multiple recording heads are attached, and is manufactured from a synthetic resin in order to achieve a lighter weight. The recording heads are anchored to the sub-carriage using screws, having been positioned relative to the sub-carriage.

However, rotational momentum is applied to the sub-carriage when screwing the recording heads down onto the sub-carriage, and thus there has been the possibility that the frame-shaped sub-carriage will deform as a result. In particular, when sequentially attaching multiple recording heads to the sub-carriage, the rotational momentum is applied to the sub-carriage each time an individual recording head is affixed thereto, and thus the deformation of the sub-carriage will increase by that amount. Furthermore, even if the recording heads are attached and anchored having had their positions adjusted, the positions may be thrown off due to the deformation of the sub-carriage resulting from the rotational momentum when affixing the next recording heads to the sub-carriage after positioning the recording heads. As this deformation of the sub-carriage builds up, the relative positions of the recording heads become skewed, which in turn causes the relative positions between nozzles in respective recording heads to become skewed as well. As a result, variation occurs in the positions at which the ink lands upon the recording medium, which leads to a risk of a drop in the image quality of the recorded image and the like.

It should be noted that this type of problem is not limited to ink jet recording apparatuses provided with recording heads that eject ink; the same problem can occur in other liquid ejecting head units, and liquid ejecting apparatuses provided therewith, that employ a configuration in which multiple liquid ejecting heads are affixed to a frame-shaped head anchoring member such as the aforementioned sub-carriage.

SUMMARY

An advantage of some aspects of the invention is to provide a liquid ejecting head unit, a manufacturing method for a liquid ejecting head unit, and a liquid ejecting apparatus capable of increasing the precision with which multiple liquid ejecting heads are attached.

A liquid ejecting head unit according to an aspect of the invention includes: a liquid ejecting head having a nozzle through which a liquid is ejected; a flow channel member inside of which is formed a flow channel for the liquid supplied to the liquid ejecting head; a flow channel anchoring member that is manufactured using a material having a higher rigidity than at least the flow channel member and to which the flow channel member is anchored; and a head anchoring member to which multiple liquid ejecting heads are anchored in a positioned state. The head anchoring member includes a housing portion that houses at least part of each of the liquid ejecting heads and an opening portion that communicates with the housing portion; the flow channel anchoring member is attached to the head anchoring member so as to span across the opening portion; and each of the liquid ejecting heads is anchored to the head anchoring member to which the flow channel anchoring member is attached.

It is preferable that the above configuration employ a configuration in which the liquid ejecting heads are anchored to the head anchoring member using screws.

According to this aspect of the invention, the liquid ejecting heads are respectively anchored to the head anchoring member to which the flow channel anchoring member has been attached; accordingly, the flow channel anchoring member functions as a reinforcing plate, which suppresses the head anchoring member from deforming in the case where a force acts on the head anchoring member when the liquid ejecting heads are anchored to the head anchoring member, or in other words, when rotational momentum has been applied to the head anchoring member during the screwing down. Through this, the arrangement precision with which the liquid ejecting heads are attached can be improved. Furthermore, because the flow channel anchoring member that anchors the flow channel member is used as a reinforcement plate, it is not necessary to prepare a separate member for reinforcing the head anchoring member.

In the aforementioned configuration, it is preferable that the configuration employ a configuration in which the flow channel member is anchored to the flow channel anchoring member using screws.

According to the aforementioned configuration, the flow channel member is anchored to the flow channel anchoring member using screws, and therefore it is more difficult for rotational momentum to act on the head anchoring member when screwing down the flow channel member for anchoring, as compared to a configuration in which the flow channel member is directly screwed onto the head anchoring member. Accordingly, this can contribute to an improvement in the precision with which the liquid ejecting heads are attached.

In the aforementioned configuration, it is preferable that the configuration employ a configuration in which a wiring member for supplying signals related to liquid ejection to the liquid ejecting heads is attached to each of the liquid ejecting heads, and the flow channel anchoring member and the flow channel member each include passage openings through which the wiring members are passed.

According to the aforementioned configuration, providing the passage openings in the flow channel anchoring member and the flow channel member makes it possible to replace the wiring member without removing the flow channel member and the flow channel anchoring member from the head anchoring member, or in other words, without disassembling the liquid ejecting head unit. This improves the operability.

A manufacturing method for a liquid ejecting head unit according to another aspect of the invention is a manufacturing method for a liquid ejecting head unit that includes a liquid ejecting head having a nozzle through which a liquid is ejected, a flow channel member inside of which is formed a flow channel for the liquid supplied to the liquid ejecting head, a flow channel anchoring member that is manufactured using a material having a higher rigidity than at least the flow channel member and to which the flow channel member is anchored, and a head anchoring member to which multiple liquid ejecting heads are anchored in a positioned state, the head anchoring member including a housing portion that houses at least part of each of the liquid ejecting heads and an opening portion that communicates with the housing portion. The method includes: attaching the flow channel anchoring member to the head anchoring member so as to span across the opening portion; and anchoring each of the liquid ejecting heads to the head anchoring member to which the flow channel anchoring member is attached.

Furthermore, a liquid ejecting apparatus according to another aspect of the invention includes a liquid ejecting head unit having: a liquid ejecting head having a nozzle through which a liquid is ejected; a flow channel member inside of which is formed a flow channel for the liquid supplied to the liquid ejecting head; a flow channel anchoring member that is manufactured using a material having a higher rigidity than at least the flow channel member and to which the flow channel member is anchored; and a head anchoring member to which multiple liquid ejecting heads are anchored in a positioned state. The head anchoring member includes a housing portion that houses at least part of each of the liquid ejecting heads and an opening portion that communicates with the housing portion. The flow channel anchoring member is attached to the head anchoring member so as to span across the opening portion, and each of the liquid ejecting heads is anchored to the head anchoring member to which the flow channel anchoring member is attached.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the appended drawings. Although various limitations are made in the embodiment described hereinafter in order to illustrate a specific preferred example of the invention, it should be noted that the scope of the invention is not intended to be limited to this embodiment unless such limitations are explicitly mentioned hereinafter. An ink jet recording apparatus (referred to as a "printer") will be given hereinafter as an example of a liquid ejecting apparatus according to the invention.

Figure 1:
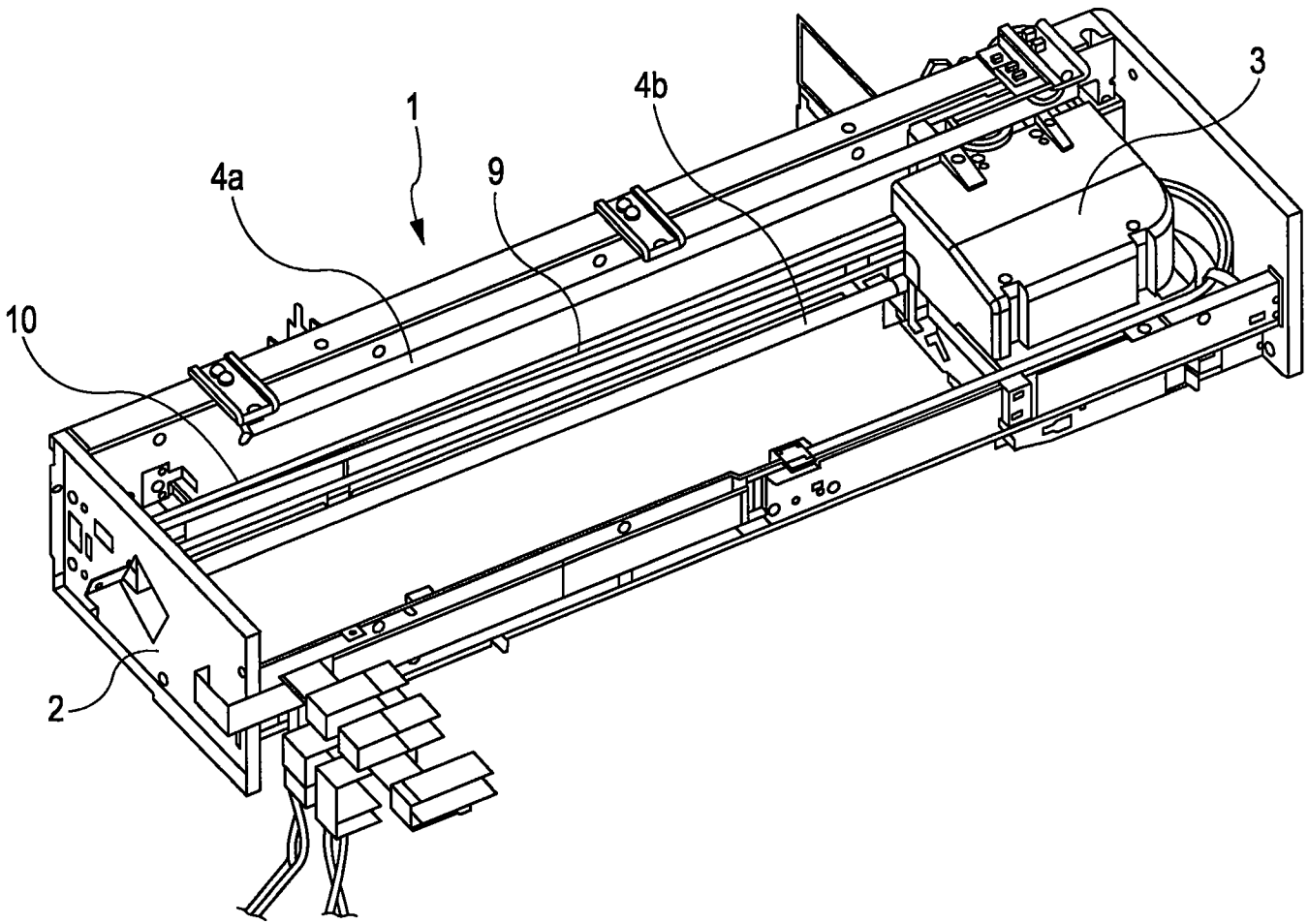
FIG. 1 is a perspective view illustrating part of the internal configuration of a printer.
Figure 2:
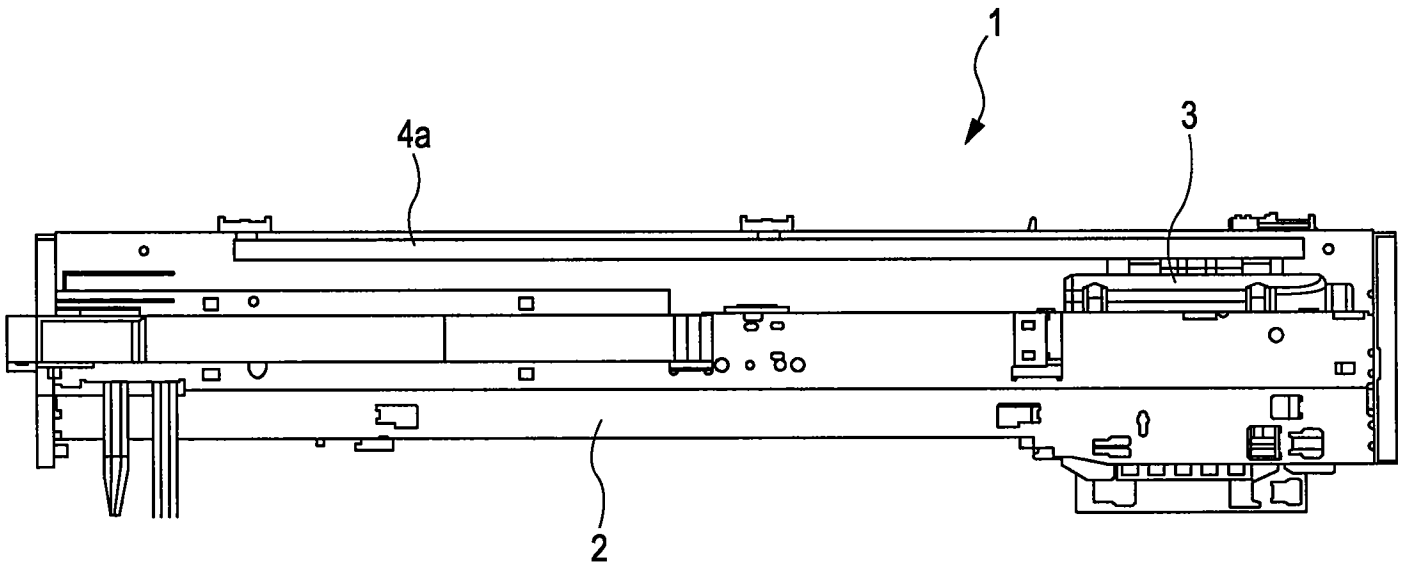
FIG. 2 is a front view of a printer.
Figure 3:
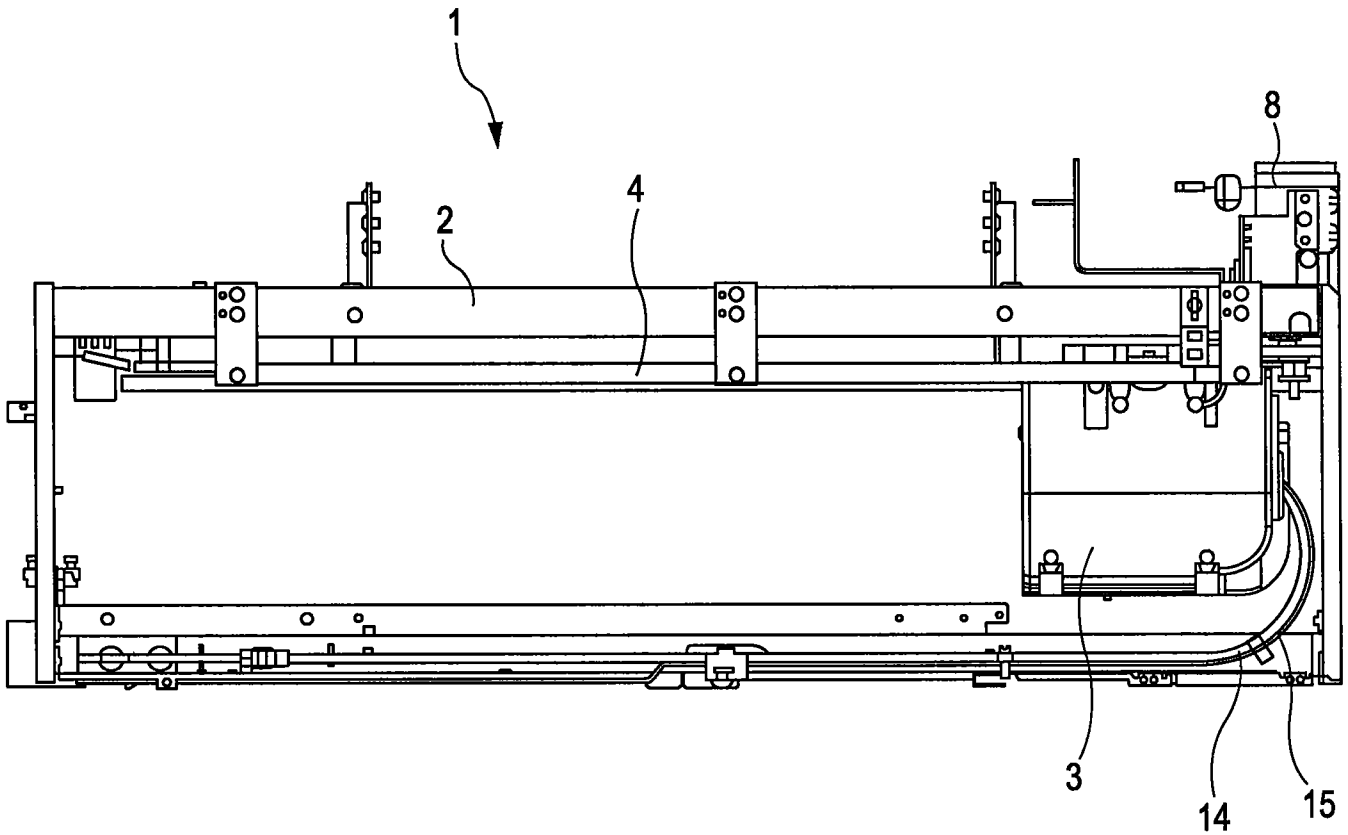
FIG. 3 is a plan view of a printer.
Figure 4:
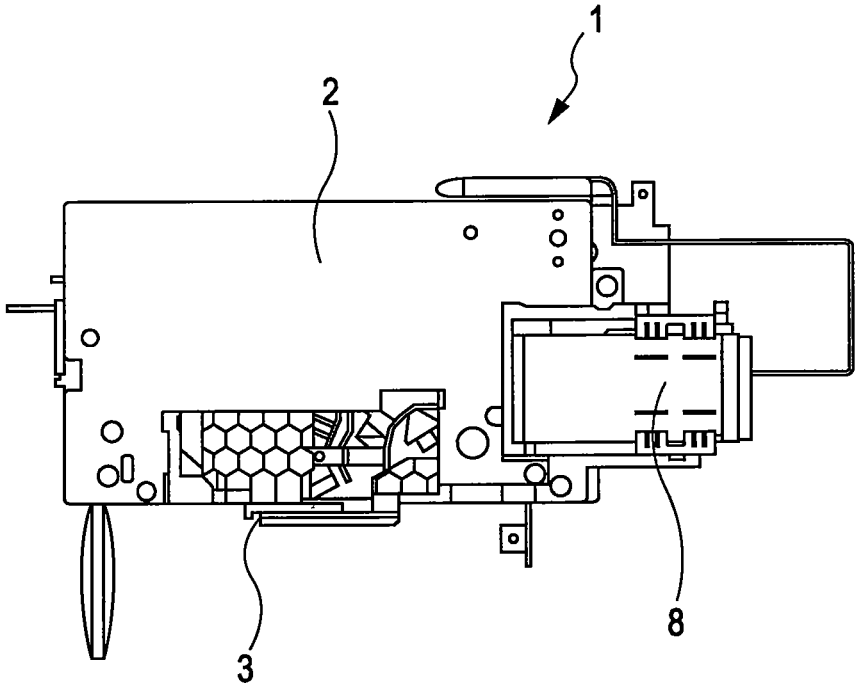
FIG. 4 is a right side view of a printer.

FIG. 1 is a perspective view illustrating part of the internal configuration of a printer 1, FIG. 2 is a front view of the printer 1, FIG. 3 is a plan view of the printer 1, and FIG. 4 is a right side view of the printer 1. The printer 1 illustrated as an example ejects ink, which is a type of liquid, toward a recording medium (landing target) such as recording paper, cloth, film, or the like. The printer 1 has a carriage assembly 3 (a type of head unit holding member) mounted within a frame 2 so as to be capable of moving back and forth in the main scanning direction, which is the direction orthogonal to the feed direction of the recording medium. A pair of upper and lower long guide rods 4*a* and 4*b* that extend along the lengthwise direction of the frame 2 are attached to an inner wall of the frame 2 at the rear surface side of the printer 1 so as to be parallel to each other with a gap provided therebetween. The guide rods 4*a* and 4*b* interlock with a bearing 7 (see FIG. 7) and the like provided on the rear surface side of the carriage assembly 3, and thus the carriage assembly 3 is supported so as to be capable of sliding along the guide rods 4*a* and 4*b*.

A carriage motor 8, serving as a driving source for moving the carriage assembly 3, is disposed on the rear surface side of the frame 2 and at one end of the main scanning direction (that is, the right end in FIG. 3). The drive shaft of this carriage motor 8 protrudes from the rear surface side of the frame 2 toward the inside, and a driving pulley (not shown) is connected to the tip portion thereof. This driving pulley is rotated by the driving of the carriage motor 8. Meanwhile, a slave pulley (not shown) is provided in a location at the opposite side in the main scanning direction relative to the driving pulley (the left end in FIG. 3). A timing belt 9 is stretched across these pulleys. The carriage assembly 3 is connected to this timing belt 9. When the carriage motor 8 is driven, the timing belt 9 rotates in accordance with the rotation of the driving pulleys, which in turn causes the carriage assembly 3 to move in the main scanning direction along the guide rods 4*a* and 4*b*.

A linear scale 10 (encoder film) extends along the inner wall on the rear surface of the frame 2, along the main scanning direction and parallel to the guide rods 4*a* and 4*b*. The linear scale 10 is a band-shaped member manufactured of a transparent resin film, and is, for example, a member in which multiple non-transparent stripes that cut across the width direction of the band are printed upon the surface of a transparent base film. Each stripe has the same width, and the stripes are formed at a constant pitch along the lengthwise direction of the band. In addition, a linear encoder (not shown) for optically reading the stripes on the linear scale 10 is provided on the rear surface side of the carriage assembly 3. The linear encoder is configured of, for example, a pair of elements including a light-emitting element and a light-receiving element disposed opposing each other, and outputs an encoder pulse based on the difference between the light-receiving state at the transparent portions of the linear scale 10 and the light-receiving state at the stripe portions of the linear scale 10. In other words, the linear encoder is a type of position information output unit, and outputs an encoder pulse based on the scanning position of the carriage assembly 3 as position information of the main scanning direction. Through this, a control unit (not shown) in the printer can control recording operations performed by a head unit 17 onto a recording medium while recognizing the scanning position of the carriage assembly 3 based on the encoder pulse from the linear encoder. The printer 1 is configured so as to be capable of a so-called bidirectional recording process, in which text, images, or the like are recorded onto the recording paper both when the carriage assembly 3 is outbound, moving from a home position at one end of the main scanning direction toward the opposite end (a full position) and when the carriage assembly 3 is inbound, returning from the full position to the home position.

As shown in FIG. 3, ink supply tubes 14 for supplying respective colors of ink to respective recording heads 18 in the head unit 17, and a signal cable 15 for supplying signal such as driving signals, are connected to the carriage assembly 3. In addition, although not shown, the printer 1 is provided with a cartridge mounting portion in which ink cartridges (liquid supply sources) that hold ink are attached in a removable state, a transport unit for transporting the recording paper, a capping unit for capping nozzle formation surfaces 53 (see FIG. 17) of the recording heads 18 while the recording heads 18 are in a standby state, and so on.

Figure 5:
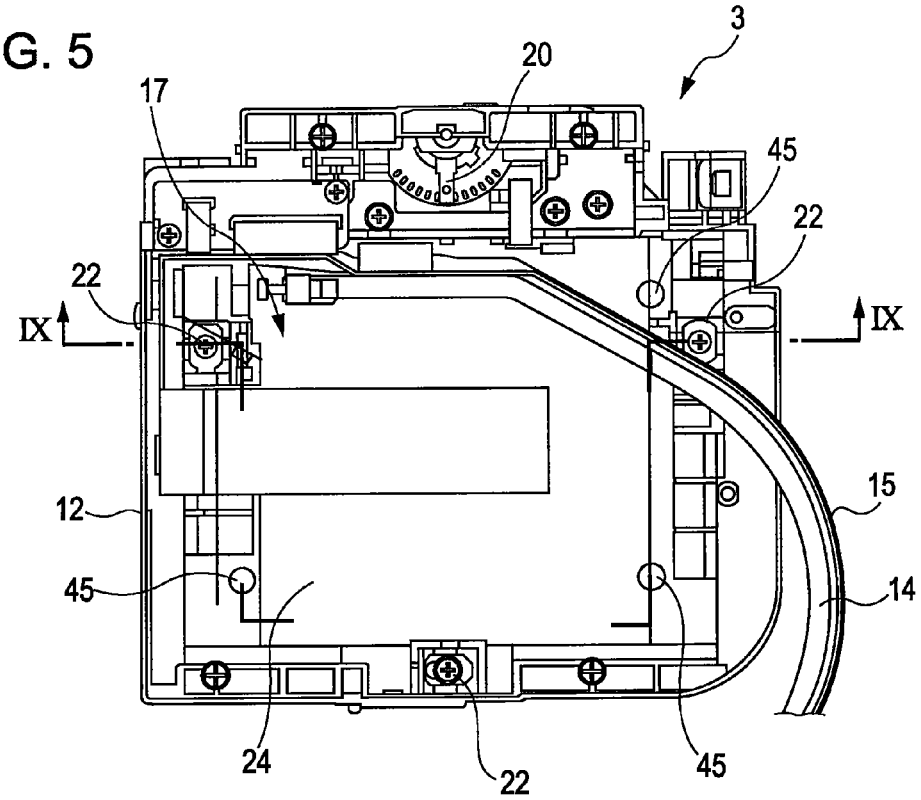
FIG. 5 is a plan view of a carriage assembly.
Figure 6:
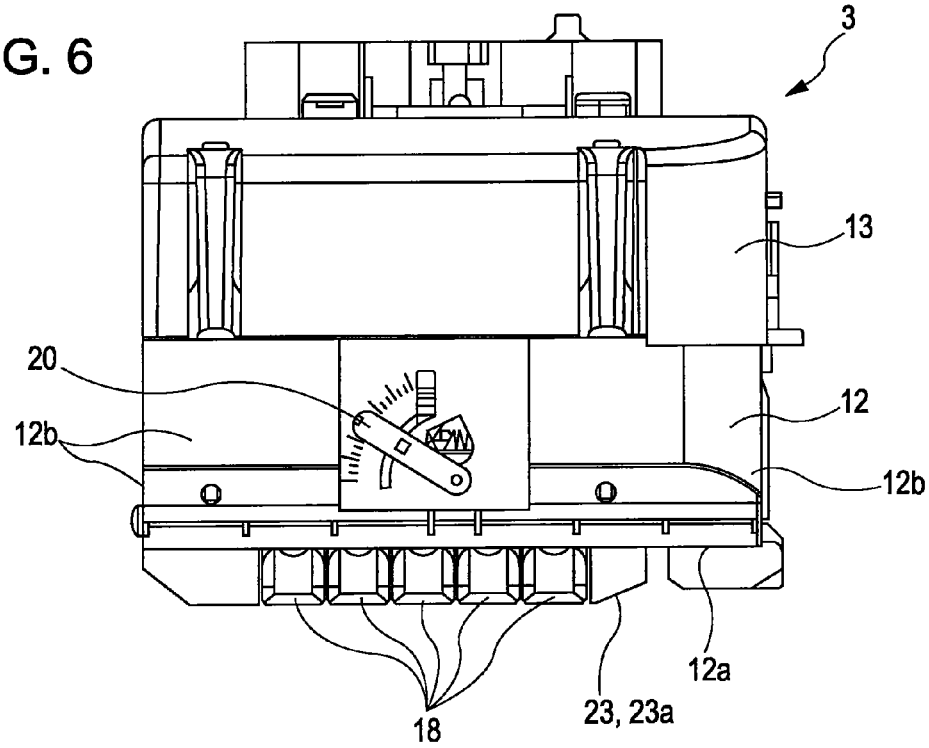
FIG. 6 is a front view of a carriage assembly.
Figure 7:
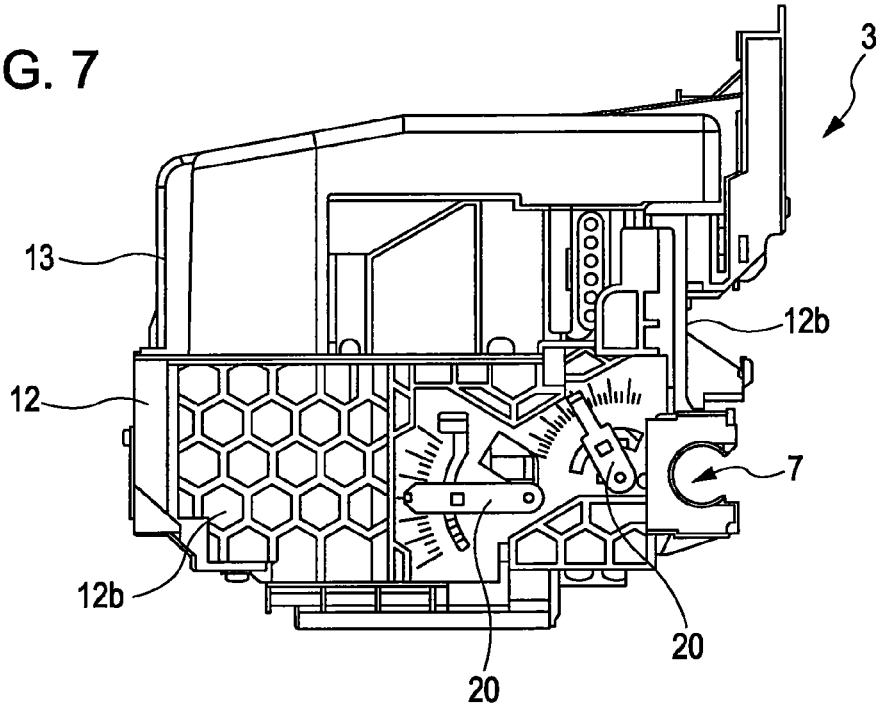
FIG. 7 is a right side view of a carriage assembly.
Figure 8:
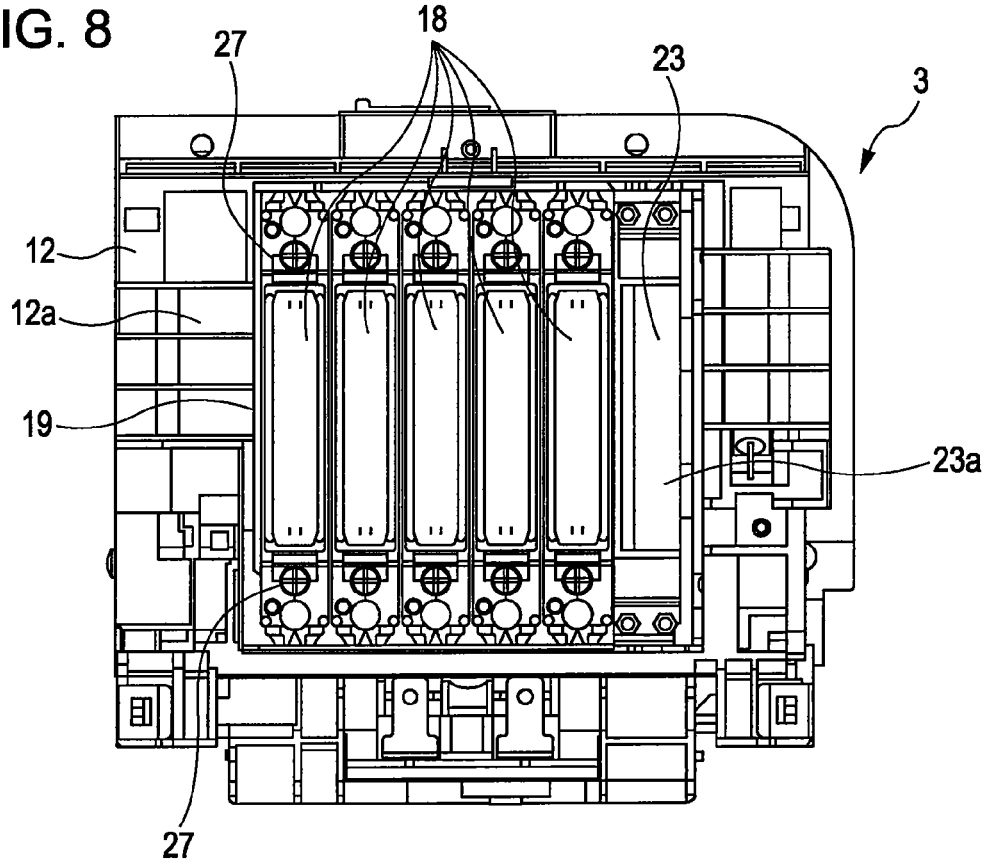
FIG. 8 is a bottom view of a carriage assembly.
Figure 9:
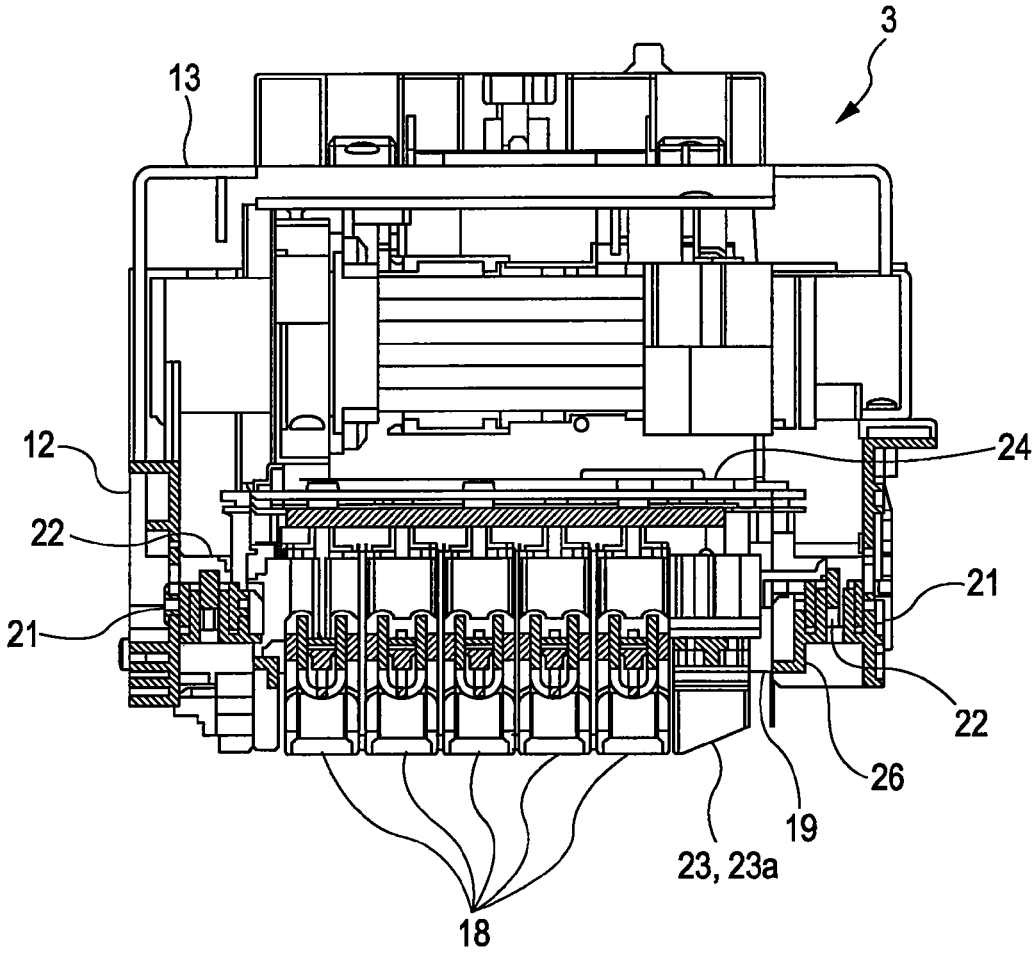
FIG. 9 is a cross-sectional view along the IX-IX line shown in FIG. 5.

FIG. 5 is a plan view (top view) of the carriage assembly 3, FIG. 6 is a front view of the carriage assembly 3, FIG. 7 is a right side view of the carriage assembly 3, FIG. 8 is a bottom view of the carriage assembly 3. Meanwhile, FIG. 9 is a cross-sectional view along the IX-IX line shown in FIG. 5. Note that FIG. 5 illustrates a state in which a carriage cover 13 has been removed. The carriage assembly 3 is configured of a main carriage unit 12 inside which the head unit 17 (a type of liquid ejecting head unit according to the invention), which will be discussed later, is installed, and the carriage cover 13 that covers an opening in the top of the main carriage unit 12; the carriage assembly 3 is a hollow box-shaped member that can be split into top and bottom portions, and is manufactured of, for example, a synthetic resin. The main carriage unit 12, in turn, is configured of an approximately rectangular-shaped base plate portion 12*a* and side wall portions 12*b* that protrude upwards from each of the four side edges of the base plate portion 12*a*; the head unit 17 is housed within the space surrounded by the base plate portion 12*a* and the side wall portions 12*b*. A base portion opening 19 for exposing the nozzle formation surfaces 53 of the respective recording heads 18 in the head unit 17 housed in this manner is provided in the base plate portion 12*a*. When the head unit 17 is housed within the main carriage unit 12, the nozzle formation surfaces 53 of the recording heads 18 protrude downward (toward the recording medium when recording operations are being carried out), from the base portion opening 19 in the base plate portion 12*a*, beyond the base of the main carriage unit 12.

Multiple eccentric cams 21 (see FIG. 9 and FIG. 15) for adjusting the attitude of the head unit 17 housed within the main carriage unit 12 are provided between the main carriage unit 12 and the head unit 17. Furthermore, multiple adjustment levers 20 for rotating the eccentric cams 21 are provided in the main carriage unit 12. By operating these adjustment levers 20, the eccentric cams 21 rotate, causing the cam diameter from the rotational center to the outer circumferential surface to increase and decrease; the configuration is such that the attitude, such as the position, slope, and so on, of the head unit 17 housed within the main carriage unit 12 can be adjusted relative to the main carriage unit 12.

Figure 10A:
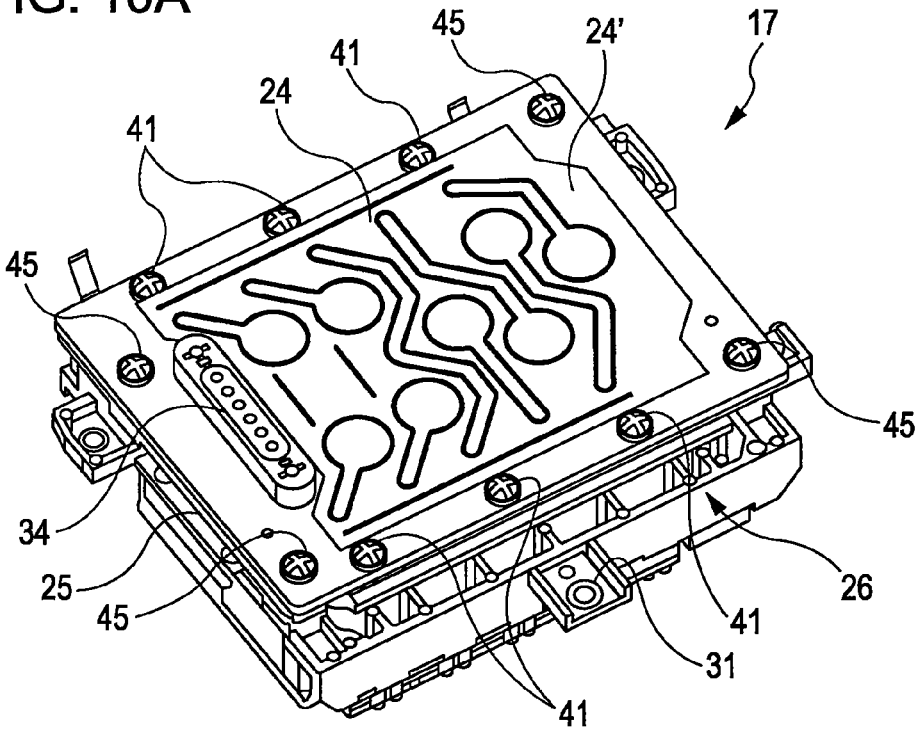
FIGS. 10A and 10B are perspective views of a head unit.
Figure 10B:
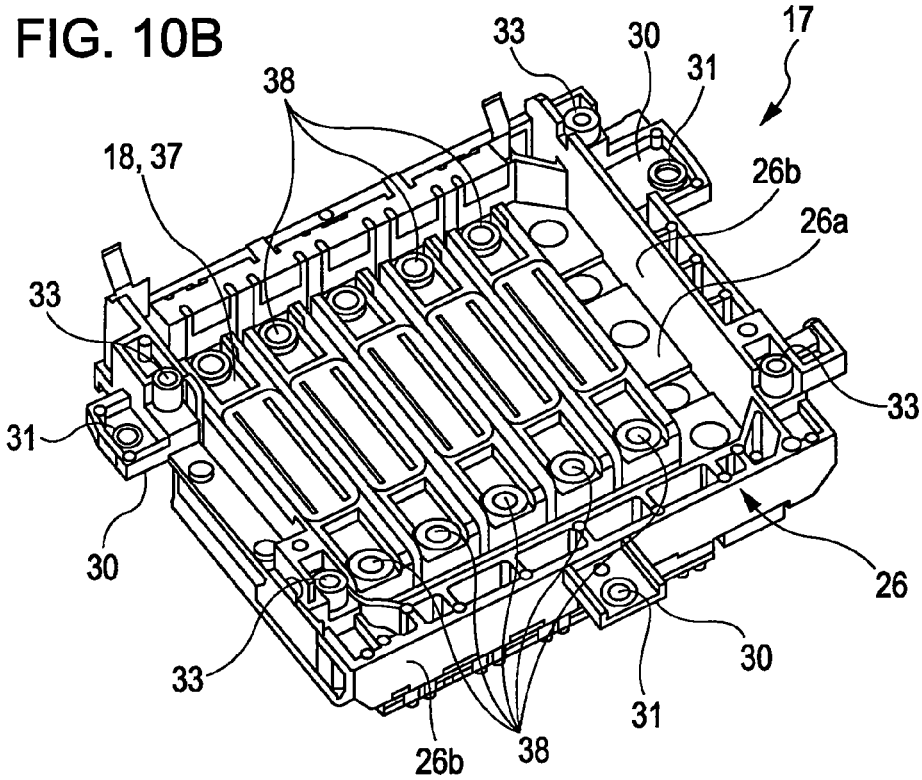
Figure 11:
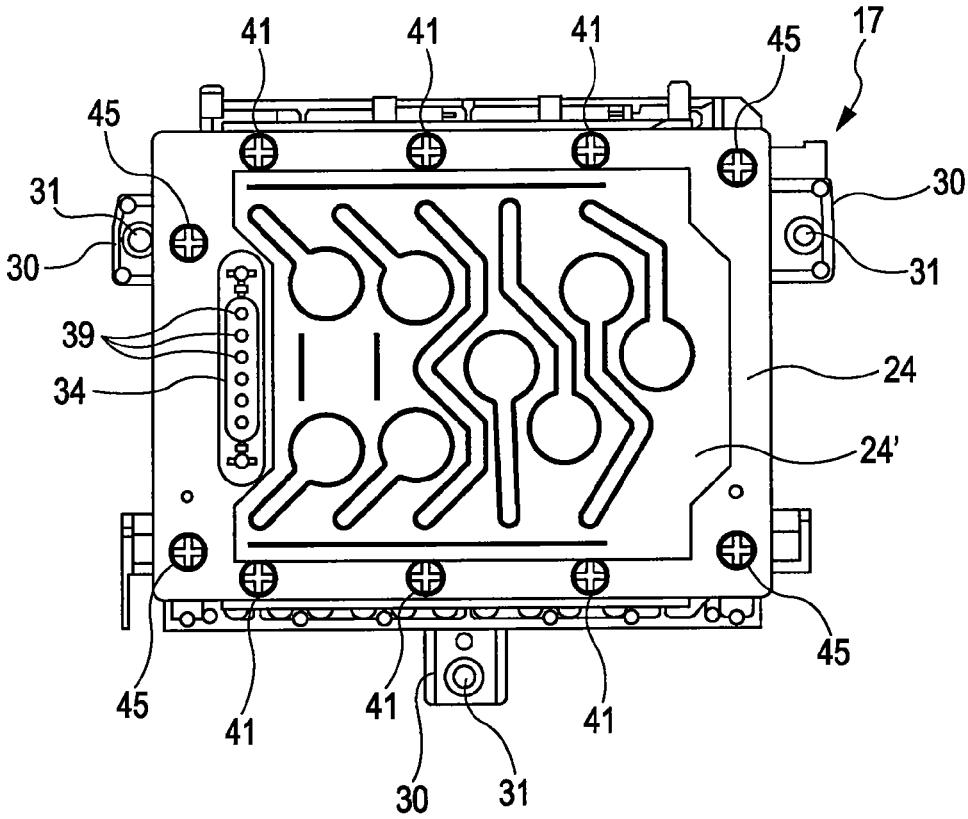
FIG. 11 is a plan view of a head unit.
Figure 12:
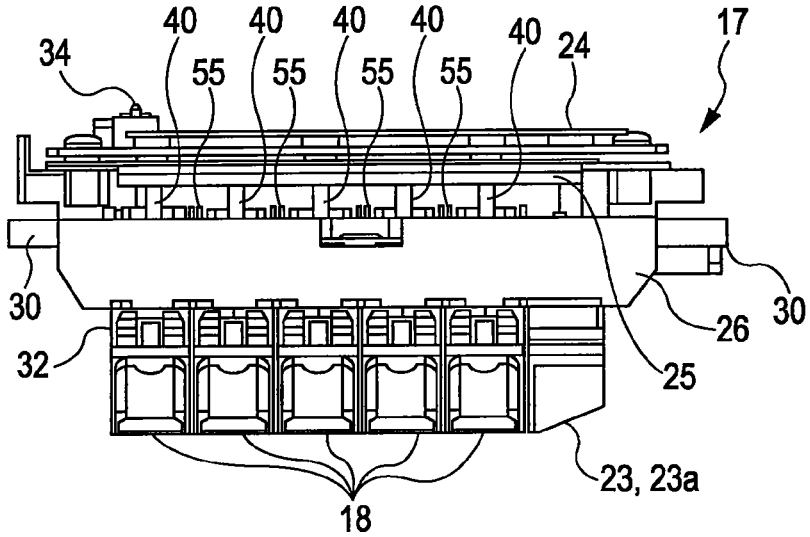
FIG. 12 is a front view of a head unit.
Figure 13:
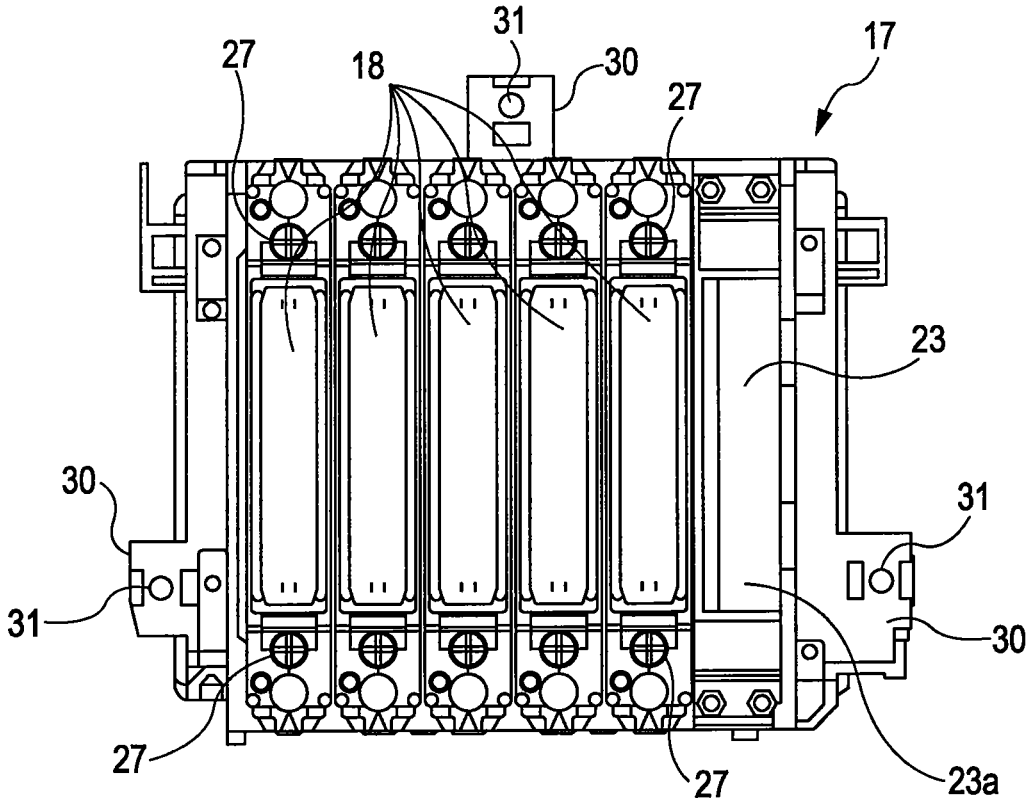
FIG. 13 is a bottom view of a head unit.
Figure 14:
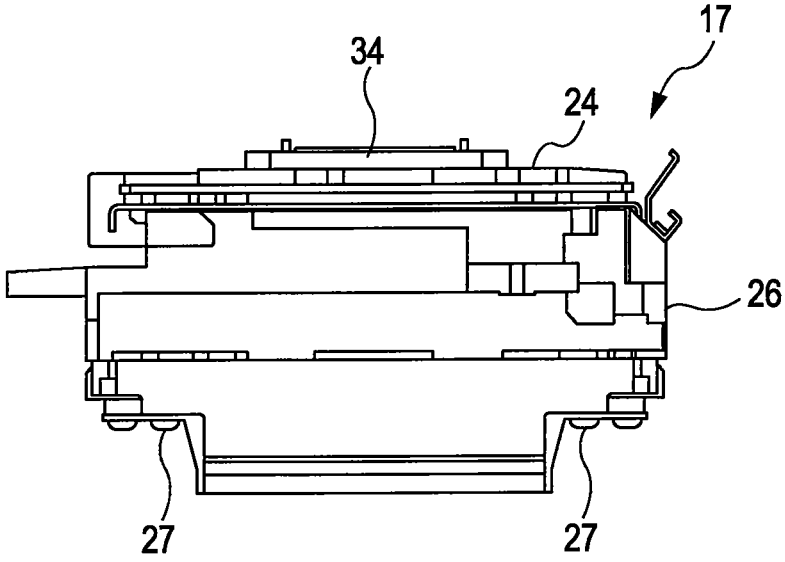
FIG. 14 is a right side view of a head unit.
Figure 15:
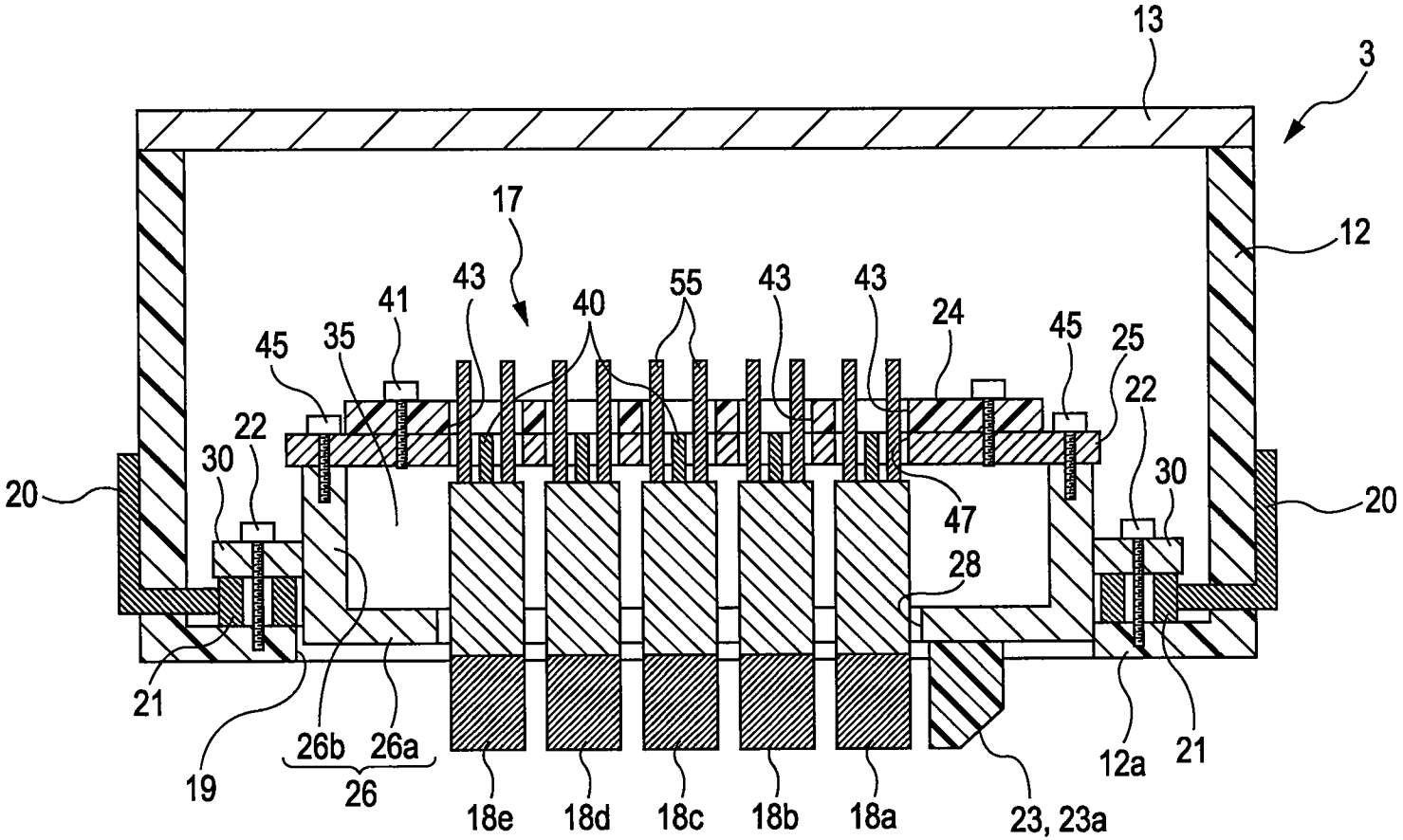
FIG. 15 is a cross-sectional view illustrating a more simplified configuration of a carriage assembly.

FIGS. 10A and 10B are perspective views of the head unit 17, where FIG. 10A illustrates a state in which a flow channel member 24 and a flow channel anchoring plate 25 are attached, and FIG. 10B illustrates a state in which the flow channel member 24 and the flow channel anchoring plate 25 have been removed. Meanwhile, FIG. 11 is a plan view (top surface view) of the head unit 17, FIG. 12 is a front view of the head unit 17, FIG. 13 is a bottom view of the head unit 17, and FIG. 14 is a right side view of the head unit 17. Finally, FIG. 15 is a cross-sectional view illustrating a more simplified configuration of the carriage assembly 3, in order to facilitate the descriptions.

The head unit 17 integrates the multiple recording heads 18 and so on as a single unit, and includes a sub-carriage 26 (a type of a head anchoring member according to the invention) in which the recording heads 18 are attached, the flow channel member 24, and the flow channel anchoring plate 25. The sub-carriage 26 is formed as a hollow box-shaped member whose upper surface is open, and includes a plate-shaped base portion 26*a* to which the recording heads 18 are anchored and four upright wall portions 26*b* that protrude upward from the four outer sides of the base portion 26*a*. The space surrounded by the base portion 26*a* and the four upright wall portions 26*b* functions as a housing portion 35 (see FIG. 15) that houses at least part of the recording heads 18 (mainly, sub-tanks 37). Meanwhile, an upper opening 36 (see FIG. 16) surrounded by the four upright wall portions 26*b* corresponds to an opening portion according to the invention. In other words, the upper opening 36 is an opening portion that communicates with the housing portion 35. The sub-carriage 26 according to this embodiment is manufactured from a metal such as aluminum, and thus has a higher rigidity than the carriage assembly 3, which is made from a synthetic resin. A head passage opening 28 through which the multiple recording heads 18 can pass (in other words, that is common for the recording heads 18) is provided in what is the approximate center of the base portion 26*a*. Accordingly, the base portion 26*a* is a frame-shaped member. The head passage opening 28 is also an opening portion that communicates with the housing portion 35. Furthermore, the head passage opening 28 houses part of the recording heads 18 therein, and thus can also be said to be part of the housing portion 35. Fastening holes 29 (see FIG. 18) are provided in the bottom surface of the base portion 26*a* (on the side that opposes the recording medium during recording) in correspondence with the positions at which the recording heads 18 are attached. In this embodiment, the fastening holes 29 are provided at both ends in the direction that corresponds to the nozzle row direction, on either side of the head passage opening 28, at the locations in which each of the recording heads 18 are attached; the fastening holes 29 are provided in pairs at a total of four positions, in correspondence with sub-carriage insertion holes 32" in spacers 32, which will be discussed later.

In this embodiment, a total of five recording heads 18 are affixed to the base portion 26*a*, and are housed within the housing portion 35, with the sub-tanks 37 (mentioned later) being passed from the downward side of the head passage opening 28 and the spacers 32 (see FIG. 18) between the recording heads 18 and the base portion 26*a*; the recording heads 18 are arranged side-by-side in the direction orthogonal to the nozzle rows, as shown in FIG. 13. Furthermore, in this embodiment, head protection members 23 are attached at one end of each of the recording heads 18 in the row direction (that is, the right end in FIG. 15), so as to be adjacent to the recording heads 18. The head protection members 23 are members that protect the recording heads 18 from the recording paper and so on during recording operations, and are manufactured from, for example, a synthetic resin. As shown in FIG. 13, the dimensions of the head protection members 23 when viewed from above (that is, the depth in the nozzle row direction and the width in the direction orthogonal to the nozzle rows) are set to be approximately the same as the corresponding dimensions of the recording heads 18, and, like the recording heads 18, are screwed down onto the base portion 26*a*. As shown in FIG. 15, the head protection members 23 are, when viewed from the front, shaved off so that the corner of the leading surface (that is, the surface of the side that opposes the recording medium during recording) that is on the opposite side as the corner that faces the recording head 18 is sloped relative to the leading surface. This shaved surface forms a tapered surface 23*a* that slopes upward from the side facing the recording heads 18 toward the opposite side.

As shown in FIG. 11, flange portions 30 are provided in three of the four upright wall portions 26*b* of the sub-carriage 26, so as to protrude to the side. Note that the flange portions 30 are not shown in FIG. 16. Insertion holes 31 are provided in the flange portions 30, in correspondence with three attachment screw holes (not shown) provided at the positions for attaching the head unit 17 to the base plate portion 12*a* of the main carriage unit 12. The head unit 17 is housed within and anchored to the inside of the main carriage unit 12 by passing head unit anchoring screws 22 through the insertion holes 31 and fastening (threading) those screws into the attachment screw holes of the base plate portion 12*a* in the main carriage unit 12 in a state in which the attachment screw holes have each been positioned relative to their corresponding insertion holes 31. Note that as described above, prior to the head unit 17 being permanently anchored to the main carriage unit 12, the attitude of the head unit 17, such as the position, slope, and so on thereof, relative to the main carriage unit 12 is adjusted by operating the aforementioned adjustment levers 20. Furthermore, anchoring screw holes 33 for anchoring the flow channel anchoring plate 25 (mentioned later) are provided in the upper end surfaces of the four upright wall portions 26*b* of the sub-carriage 26, in a total of four locations.

Figure 16:
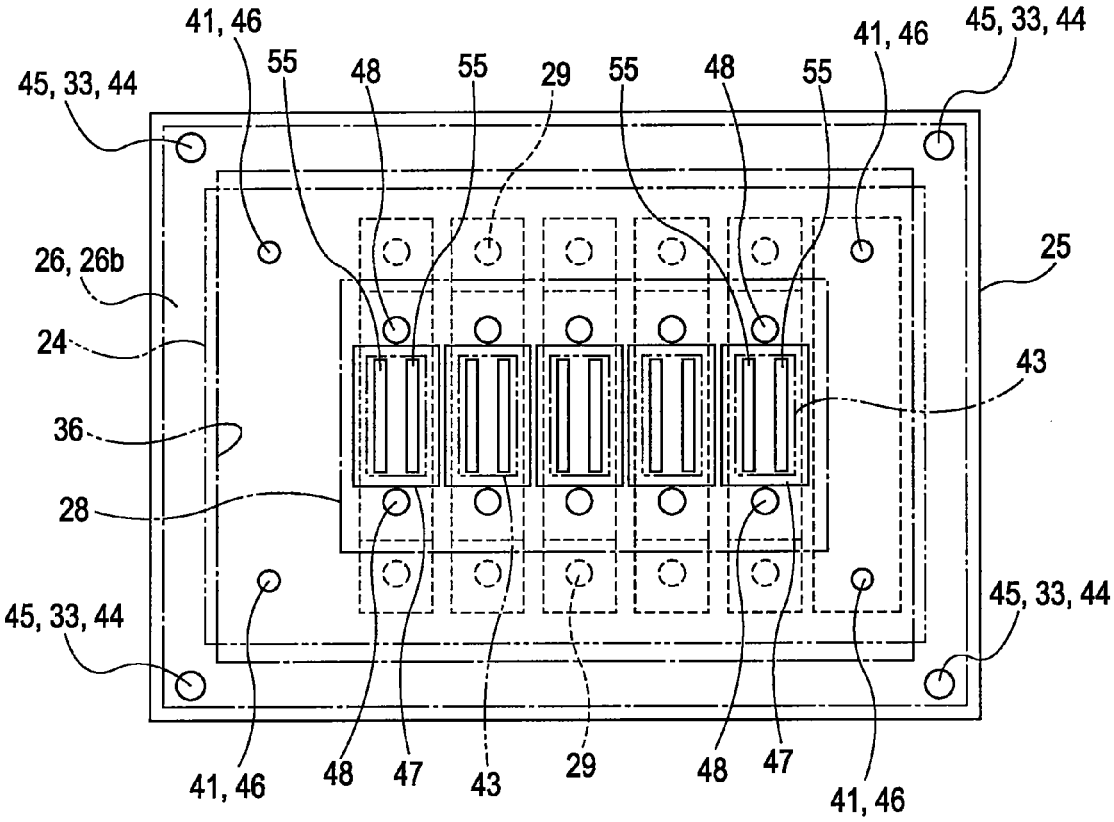
FIG. 16 is a plan view of a flow channel anchoring plate.

The flow channel member 24 is a box-shaped member that is thin in the vertical direction, and is manufactured of, for example, a synthetic resin. Note that a cover member 24' is attached to the upper surface of the flow channel member 24 (that is, the surface on the opposite side of the surface that connects to the flow channel anchoring plate 25), as shown in FIGS. 10A, 10B, and 11. Ink distribution channels (not shown) are formed, within the flow channel member 24, partitioned from each other for each of the colors of ink, in correspondence with respective flow channel connection portions 38 of the sub-tanks 37 (mentioned later) in the respective recording heads 18. Flow channel insertion holes (not shown), through which flow channel anchoring screws 41 are inserted, are provided in the upper surface of the flow channel member 24, passing through the flow channel member 24 in the vertical direction, and are provided in a total of six locations. Note that in FIG. 16, the flow channel anchoring screws 41 corresponding to two of the flow channel insertion holes are not shown. A tube connection portion 34 is provided in the upper surface of the flow channel member 24. As shown in FIG. 11, multiple introduction openings 39 corresponding to the respective colors of ink are provided within this tube connection portion 34. The introduction openings 39 communicate with the ink distribution channels for the corresponding colors. When the stated ink supply tubes 14 are connected to the tube connection portion 34, ink supply channels for the respective colors within the ink supply tubes 14 communicate with the corresponding introduction openings 39 in a fluid-tight state. Through this, the ink of the respective colors that is transmitted from the ink cartridge through the ink supply tubes 14 is introduced into the respective ink distribution channels within the flow channel member 24 via the introduction openings 39. Furthermore, as shown in FIG. 15 and FIG. 16, rectangular wiring openings 43 (a type of passage opening according to the invention) are provided in the flow channel member 24 so as to pass therethrough in the vertical direction, and are provided at positions that correspond to the respective recording heads 18. These wiring openings 43 are openings that communicate with wiring member passage openings 47 in the flow channel anchoring plate 25 (mentioned later), and flexible cables 55 for the recording heads 18 are passed therethrough.

As shown in FIG. 12 and FIG. 15, connection flow channels 40 that protrude downward are provided in the bottom surface of the flow channel member 24 at positions that correspond to the flow channel connection portions 38 of the sub-tanks 37 in each of the recording heads 18. The connection flow channels 40 are hollow cylindrical members within which introduction channels (not shown) that communicate with the ink distribution channels for respective colors of ink are formed. The connection flow channels 40 are configured so as to be inserted into corresponding flow channel connection portions 38 of the sub-tanks 37 in the recording heads 18, and to link therewith in a fluid-tight state. The ink that has passed through the ink distribution channels within the flow channel member 24 is supplied to the sub-tanks 37 of the recording heads 18 via the connection flow channels 40 and the flow channel connection portions 38. In other words, the ink supply tubes 14 and the sub-tanks 37 are connected to each other with the flow channel member 24 therebetween.

FIG. 16 is a plan view (top view) of the flow channel anchoring plate 25. Note that the area in FIG. 16 indicated by the single-dot-dash line represents the sub-carriage 26, whereas the area indicated by the double-dot-dash line represents the flow channel member 24. The area indicated by the broken line, meanwhile, represents the recording heads 18.

The flow channel anchoring plate 25 is a plate-shaped member that anchors the aforementioned flow channel member 24, and is configured of a material that is at least as rigid as the flow channel member 24, such as a metallic plate made from aluminum, stainless steel, or the like. The dimensions of the flow channel member 24 in the lengthwise direction (that is, the direction corresponding to the nozzle row direction of the recording heads 18) and the widthwise direction (the direction orthogonal to the nozzle rows) are set to be the same as or slightly larger than the dimensions of the sub-carriage 26 in the corresponding directions, and in this embodiment, are set to sizes that enable the head passage opening 28 and the upper opening 36 of the sub-carriage 26 to be covered.

Anchoring plate insertion holes 44 corresponding to the anchoring screw holes 33 in the sub-carriage 26 are formed in the four corners of the flow channel anchoring plate 25 so as to pass through in the thickness direction of the plate. When the flow channel anchoring plate 25 is anchored to the sub-carriage 26, anchoring plate fastening screws 45 are passed through the anchoring plate insertion holes 44 and are fastened (threaded) into the anchoring screw holes 33. Furthermore, anchoring screw holes 46 for anchoring the aforementioned flow channel member 24 are provided in the flow channel anchoring plate 25 in a total of six locations corresponding to the respective flow channel insertion holes, and are located further inside (toward the center) than the positions at which the anchoring plate insertion holes 44 are provided. Note that in FIG. 16, only the anchoring screw holes 46 of four locations are shown for the sake of simplicity. When the flow channel member 24 is anchored to the upper surface of the flow channel anchoring plate 25, the flow channel anchoring screws 41 are passed through the flow channel insertion holes and are fastened (threaded) into the anchoring screw holes 46. Furthermore, the rectangular wiring member passage openings 47 (a type of passage opening according to the invention) are provided in the flow channel anchoring plate 25 at positions that correspond to the respective recording heads 18, and are provided so as to pass through in the thickness direction of the plate. These wiring member passage openings 47 are openings that communicate with the wiring openings 43 in the flow channel member 24 described above, and the flexible cables 55 for the recording heads 18 are passed therethrough. Two flexible cables 55 are provided for each of the recording heads 18 in this embodiment, and thus the wiring member passage openings 47 and the wiring openings 43 are set so that the dimensions of their openings are of a size that allows the two flexible cables 55 to be inserted thereinto and removed therefrom. Providing these wiring member passage openings 47 and wiring openings 43 makes it possible to remove and attach the flexible cables 55 while the flow channel member 24 is still attached. Here, in the case where the flow channel member 24 is to be removed when replacing the head unit 17 installed in the main carriage unit 12, there has been a risk that ink will spray from the area at which the connection flow channels 40 and the flow channel connection portions 38 connect, land upon the flexible cables 55, the connector terminals of a wiring board, or the like, and cause short circuits. With respect to this point, in this embodiment, the wires can be removed without removing the flow channel member 24, which makes it possible to suppress the occurrence of the aforementioned problem. This also improves the handling of the apparatus.

Meanwhile, escape holes 48, into which the connection flow channels 40 of the aforementioned flow channel member 24 are inserted, are provided in the flow channel anchoring plate 25 so as to be adjacent to each of the wiring member passage openings 47 on both sides thereof in the nozzle row direction, and are provided so as to pass through in the thickness direction of the plate. In other words, when the flow channel member 24 is attached to the flow channel anchoring plate 25, the connection flow channels 40 are inserted into these escape holes 48, and thus the connection flow channels 40 protrude from the bottom surface of the flow channel anchoring plate 25. Note that this flow channel anchoring plate 25 also functions as a reinforcement plate for the sub-carriage 26. This point will be described in greater detail later.

Figure 17:
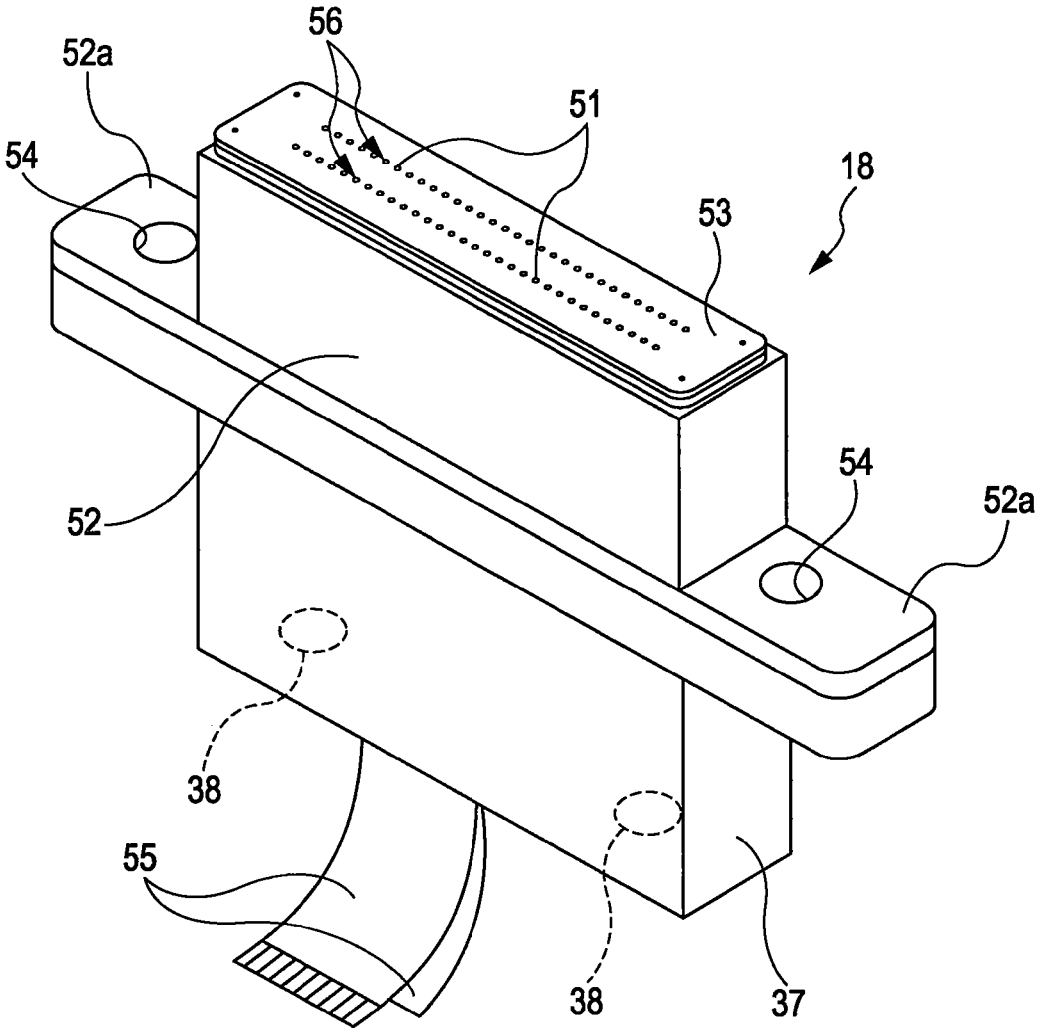
FIG. 17 is a perspective view illustrating the configuration of a recording head.

FIG. 17 is a perspective view illustrating the configuration of the recording heads 18 (a type of liquid ejecting head). Note that the basic structure and so on of each of the recording heads 18 is the same, and thus only one of the five recording heads 18 attached to the sub-carriage 26 will be described as a representative example.

The recording head 18 includes, in a head case 52, a flow channel unit that forms an ink flow channel including a pressure chamber that communicates with nozzles 51, a pressure generation unit such as a piezoelectric vibrator or a thermal element that causes fluctuations in the pressure of the ink within the pressure chamber, and so on (these units are not shown). This recording head 18 is configured so as to carry out recording operations, in which ink is ejected through the nozzles 51 and caused to land upon a recording medium such as recording paper, by a driving signal from the control unit of the printer 1 being applied to the pressure generation unit and driving the pressure generation unit. Nozzle rows 56, in which multiple nozzles 51 through which ink is ejected are arranged in rows, are configured in the nozzle formation surface 53 of each of the recording heads 18, and two such nozzle rows 56 are formed side-by-side in the direction orthogonal to those nozzle rows. A single nozzle row 56 is configured of 360 nozzle openings disposed at a pitch of, for example, 360 dpi. Ink flow channels, pressure generation units, and so on are provided individually so as to correspond to each of the nozzle rows 56, and as will be mentioned later, there are cases where the two nozzle rows 56 in a single recording head 18 have different inks allocated thereto.

The head case 52 is a hollow box-shaped member, and the flow channel units are anchored to the leading end thereof so that the nozzle formation surfaces 53 are exposed. In addition, the pressure generation unit and the like are housed within a housing space formed inside the head case 52, and the sub-tanks 37 for supplying ink to the flow channel units are mounted on the base end side (upper surface side) of the head case 52, which is on the opposite side as the leading end. Furthermore, flange portions 52*a* that protrude toward the side are formed in the upper surface side of the head case 52, and are formed on both sides in the nozzle row direction. Spacer attachment holes 54 are provided in the flange portions 52*a*, in correspondence with respective head passage holes 32' (see FIG. 18) in the spacers 32. When the spacers 32 are attached to the flange portions 52*a*, spacer fastening screws 49 are inserted into the spacer attachment holes 54.

The spacers 32 are members configured of a synthetic resin, and a total of two are attached, one each on the upper surfaces of the flange portions 52*a* (the surfaces facing the sub-tanks 37) on both sides of a single recording head 18. The head passage holes 32' are provided in the central area of the width direction of the spacers 32 (that is, the direction orthogonal to the nozzle rows when the recording heads 18 are attached), in correspondence with the spacer attachment holes 54 of the recording head 18. Meanwhile, the sub-carriage insertion holes 32" are provided on both sides of the spacers 32 in the width direction, in correspondence with the fastening holes 29 provided in the base portion 26*a* of the sub-carriage 26. In other words, one head passage hole 32' and two sub-carriage insertion holds 32" are provided in each of the spacers 32. The spacers 32 are fastened to the flange portions 52*a* on both sides of the respective recording heads 18 using the spacer fastening screws 49, prior to the recording heads 18 being attached to the sub-carriage 26. As will be mentioned later, the spacers 32 are temporarily anchored to the sub-carriage 26 using an adhesive, and are then permanently anchored using head anchoring screws 27. The recording heads 18 that have been anchored to the sub-carriage 26 can be removed from the spacers 32 and the sub-carriage 26 by unscrewing the spacer fastening screws 49 between the recording heads 18 and the spacers 32. This makes it possible to remove the recording heads 18 with ease in order to replace or repair the recording heads 18.

The aforementioned sub-tanks 37 are members for introducing the ink from the flow channel member 24 into the pressure chambers of the recording heads 18. The sub-tanks 37 have a self-sealing function that controls the introduction of ink into the pressure chambers by opening and closing a valve based on internal pressure fluctuations. The flow channel connection portions 38 that connect the connection flow channels 40 of the stated flow channel member 24 are provided on both ends of the following end (upper surface) of the sub-tanks 37 in the nozzle row direction. Ring-shaped gaskets are embedded in the flow channel connection portions 38, and the fluid-tight state of the connection flow channels 40 is maintained by these gaskets. Furthermore, two driving boards (not shown) for supplying driving signals to the pressure generation units are provided in the sub-tanks 37, and the two flexible cables 55 (a type of wiring member according to the invention) electrically connected to these driving boards are pulled through the following end side of the sub-tanks 37. These flexible cables 55 are connected to the stated signal cable 15, and driving signals and the like sent from the control unit of the printer 1 via the signal cable 15 are supplied to the pressure generation units via the driving boards.

Next, a manufacturing process (assembly process) for the aforementioned head unit 17 will be described.

First, prior to attaching the recording heads 18 to the sub-carriage 26, the flow channel anchoring plate 25 is anchored to the sub-carriage 26 (a flow channel anchoring member attachment process). When the flow channel anchoring plate 25 has been attached to the sub-carriage 26, the flow channel anchoring plate 25 spans across and covers the opening portions of the sub-carriage 26, or in other words, the head passage opening 28 and the upper opening 36. Note that the flow channel anchoring plate 25 need not completely cover the opening portions; it is sufficient if the flow channel anchoring plate 25 is attached so as to span across at least the opening portions.

As described above, the flow channel anchoring plate 25 is anchored to the sub-carriage 26 using the anchoring plate fastening screws 45. Accordingly, the flow channel anchoring plate 25 functions as a reinforcement plate by being attached to the sub-carriage 26 so as to span across the opening portions, and can therefore increase the rigidity of the sub-carriage 26. The multiple recording heads 18 are then positioned relative to and attached to the sub-carriage 26, which has had its rigidity increased by having the flow channel anchoring plate 25 attached (a head attachment process). In this embodiment, a total of five recording heads 18, or a first recording head 18*a*, a second recording head 18*b*, a third recording head 18*c*, a fourth recording head 18*d*, and a fifth recording head 18*e*, are sequentially attached to the sub-carriage 26 (see FIG. 15).

Figure 18:
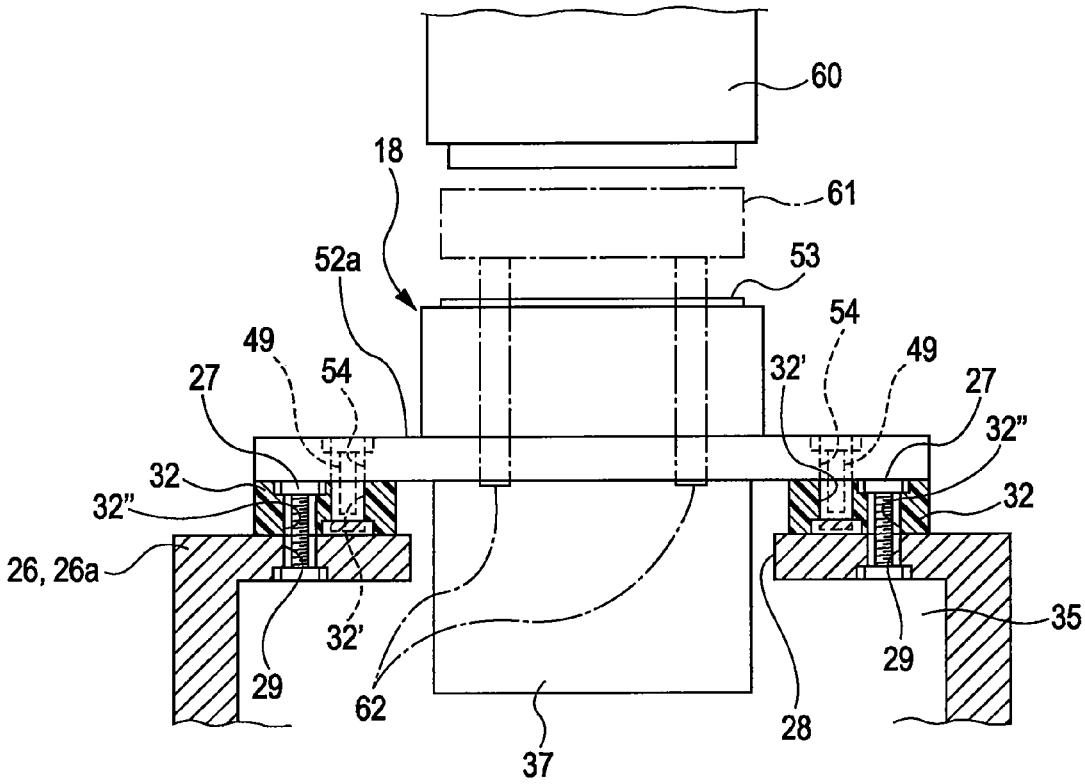
FIG. 18 is a schematic diagram illustrating an apparatus configuration for attaching a recording head to a sub-carriage.

FIG. 18 is a schematic diagram illustrating an apparatus configuration for attaching the recording heads 18 to the sub-carriage 26. This apparatus includes an imaging unit 60 such as a CCD camera and a head movement mechanism 61 for moving the recording heads 18 in a held state. Note that in FIG. 18, the horizontal direction represents the nozzle row direction, whereas the depth direction (the vertical direction in FIG. 18) represents the direction orthogonal to the nozzle rows. Furthermore, the imaging unit 60 and the sub-carriage 26 are anchored at relative positions having been positioned in a highly-precise manner. The recording heads 18 to be attached are housed within the housing portion 35 having had the sub-tanks 37 passed through the head passage opening 28 and with the spacers 32 located between the upper surface side of the flange portions 52*a* and the base portion 26*a* of the sub-carriage 26; the nozzle formation surfaces 53 are set in an orientation so as to oppose the imaging unit 60. As described above, the spacers 32 are fastened, in advance, to the flange portions 52*a* of the recording heads 18 using the spacer fastening screws 49. Note that the general disposal positions of the recording heads 18 relative to the sub-carriage 26 may be regulated by passing the head anchoring screws 27 through the head passage holes 32' provided in the spacers 32 and the fastening holes 29 of the sub-carriage 26, in a state in which the recording heads 18 have been set on the base portion 26*a* of the sub-carriage 26. In this case, the diameter of the spacer attachment holes 54 in this embodiment is set to be slightly larger than the outer diameter of the head anchoring screws 27, and thus a gap is formed between the spacer attachment holes 54 and the head anchoring screws 27. This gap serves as an allowance for adjustment for the disposal positions of the recording heads 18 relative to the sub-carriage 26.

The head movement mechanism 61 includes an arm 62 (a type of head holding tool) that extends toward the base portion 26*a* of the sub-carriage 26. The head movement mechanism 61 holds the recording heads 18 to be attached using the arm 62. The head attachment process in this embodiment positions (adjusts the positions of) a recording head 18 relative to the base portion 26*a* of the sub-carriage 26 by, in a state in which the recording head 18 is held by the arm 62, moving the recording head 18 in the nozzle row direction or in the direction orthogonal to the nozzle row direction, or by rotating the recording head 18 in the direction of the nozzle formation surface. To be more specific, in a position adjustment process of disposing the recording head 18 at a predetermined position in the base portion 26*a*, a temporary anchoring process of temporarily anchoring the recording head 18 to the base portion 26*a* using an adhesive, and a permanent anchoring process of anchoring the recording head 18 to the base portion 26*a* using the head anchoring screws 27 after the temporary anchoring has been carried out, are performed.

First, in the position adjustment process, the recording head 18 is set at a predetermined position in the sub-carriage 26 with the spacer 32 therebetween, with the nozzle formation surface 53 oriented so as to oppose the imaging unit 60. An image captured by the imaging unit 60 is displayed in a monitor (not shown), and the recording head 18 is positioned relative to the base portion 26*a* using image recognition. For example, nozzle marks specifying the disposal positions of multiple (at least two) specific nozzles 51 (called "reference nozzles 51" hereinafter) in the recording head 18 are displayed so as to be superimposed upon the captured image. These nozzle marks are displayed in virtual positions in the monitor image, located in the proper positions (that is, accurately-positioned areas) that correspond to the reference nozzles 51 in the recording head 18. Accordingly, the position of the recording head 18 is adjusted by the head movement mechanism 61 so that the reference nozzles 51 in the recording head displayed as an image in the monitor overlap with the corresponding nozzle marks, which makes it possible to position the recording heads 18 at the proper positions on the base portion 26*a* in a highly-precise manner.

Note that the method for positioning the recording heads 18 relative to the base portion 26*a* of the sub-carriage 26 is not limited to the image recognition described as an example; for example, a method in which the movement error of stages is calibrated using an alignment plate such as a glass plate in which alignment marks have been formed through photolithography may be employed instead.

Furthermore, the configuration is not limited to one in which positioning is carried out by aligning the reference nozzles 51 with nozzle marks on a monitor, and a configuration in which, for example, reference marks are formed in the nozzle formation surfaces 53 so as to be distanced from the formation positions of the nozzles 51 and positioning is carried out by aligning the reference marks with the nozzle marks can also be employed.

Further still, a configuration in which the recording heads 18 are directly positioned relative to the base portion 26*a*, without providing the spacers 32 between the recording heads 18 and the base portion 26*a*, can be employed as well.

In the position adjustment process, if the recording heads 18 are disposed in the proper positions, the temporary anchoring process is then carried out. In this temporary anchoring process, the adhesive is poured between the spacers 32 and the base portion 26*a* through capillarity in a state in which the recording heads 18 are disposed in the proper positions on the base portion 26*a* and are held in those positions by the head movement mechanism 61 using a clamp; the temporary anchoring is complete when the adhesive has cured. A so-called instant adhesive whose primary component is cyanoacrylate is suited for the adhesive.

When the position adjustment process and the temporary anchoring process have been completed, the permanent anchoring process, for permanently anchoring the recording heads 18 to the base portion 26*a*, is carried out. In this embodiment, the recording heads 18 are permanently anchored to the proper positions in the base portion 26*a* by screwing down the spacers 32 and the base portion 26*a* using the head anchoring screws 27. At this time, rotational momentum is applied to the sub-carriage 26 during the screwing. With a configuration in which multiple recording heads 18 are attached, as with the sub-carriage 26 according to this embodiment, the opening portions are larger by that amount, and thus the sub-carriage 26 deforms easily when rotational momentum is applied thereto when screwing down the recording heads 18. However, as described above, the flow channel anchoring plate 25 is attached to the sub-carriage 26 in advance, and the flow channel anchoring plate 25 increases the rigidity of the sub-carriage 26 by functioning as a reinforcement plate; accordingly, deformation of the sub-carriage 26 is suppressed in the case where rotational momentum has been applied thereto during the screwing. Through this, the precision with which the recording heads 18 are attached can be improved. Furthermore, because the flow channel anchoring plate 25 that anchors the flow channel member 24 is used as a reinforcement plate, it is not necessary to prepare a separate member for reinforcing the sub-carriage 26.

By sequentially carrying out the head attachment process for attaching each of the recording heads 18 to the sub-carriage 26 in this order, the recording heads 18 are anchored having been positioned in a highly-precise manner. When the recording heads 18 are attached to the sub-carriage 26 having been positioned relative thereto, as shown in FIG. 16, the flexible cables 55 of the recording heads 18 face into the wiring member passage openings 47 of the flow channel anchoring plate 25 and the wiring openings 43 of the flow channel member 24. After this, the flow channel member 24 is attached to the upper surface of the flow channel anchoring plate 25, and is anchored using the flow channel anchoring screws 41 (a flow channel member attachment process). At this time, the connection flow channels 40 of the flow channel member 24 are inserted into the escape holes 48 of the flow channel anchoring plate 25, and the connection flow channels 40 are inserted into the respective flow channel connection portions 38 of the sub-tanks 37 in the recording heads 18 and linked thereto in a fluid-tight state. The flow channel member 24 is screwed onto the flow channel anchoring plate 25 in this manner, and therefore it is more difficult for rotational momentum to act on the sub-carriage 26 when screwing down the flow channel member 24 for attachment, as compared to a configuration in which the flow channel member 24 is directly screwed onto the sub-carriage 26. Accordingly, this can contribute to an improvement in the precision with which the recording heads 18 are attached. Note that the flow channel member 24 may be anchored to the flow channel anchoring plate 25 prior to the recording heads 18 being attached to the sub-carriage 26. Through this, it is possible to prevent, with more certainty, the influence of the screwing when attaching the flow channel member 24.

The head unit 17 is completed when the aforementioned processes have been carried out. This head unit 17 is, as mentioned earlier, housed within the main carriage unit 12 in a state in which the nozzle formation surfaces 53 of the recording heads 18 are exposed from the base portion opening 19 in the base plate portion 12*a* of the main carriage unit 12, and the head unit 17 is anchored, using the head unit anchoring screws 22, to the main carriage unit 12 after having its attitude, such as its position, slope, and so on, adjusted relative to the main carriage unit 12.

It should be noted that the invention is not limited to the above-described embodiment, and many variations based on the content of the aspect of the invention are possible.

For example, the shape of the sub-carriage 26 that serves as the head anchoring member is not limited to a box shape whose upper surface is open, as described above. As long as the head anchoring member is a member having a base portion 26*a* to which multiple recording heads 18 are attached and in which an opening portion involved in housing the recording heads 18 is provided, the invention can be applied.

In addition, the configuration and number of the recording heads 18 attached to the sub-carriage 26 are not limited to the examples disclosed in the aforementioned embodiment, either.

Furthermore, although the aforementioned embodiment illustrates an example of a configuration in which ink is ejected while moving the recording heads 18 back and forth relative to the recording medium, the invention is not limited thereto. For example, a configuration in which the positions of the recording heads 18 are fixed and the ink is ejected while moving the recording medium relative to the recording heads 18 can be employed as well.

Furthermore, although the ink jet printer 1, which is a type of liquid ejecting apparatus, is described as an example in the foregoing, the invention can be applied to other liquid ejecting apparatuses that eject ink using multiple ejection driving pulses. For example, the invention can also be applied to display manufacturing apparatuses for manufacturing color filters for liquid-crystal displays and so on, electrode manufacturing apparatuses for forming electrodes for organic EL (electroluminescence) displays, FEDs (field emission displays), and so on, chip manufacturing apparatuses for manufacturing biochips (biochemical devices), micropipettes for supplying precise small amounts of sample solutions, and so on.

What is claimed is:

1. A liquid ejecting head unit comprising:

a liquid ejecting head having a nozzle through which a liquid is ejected;

a flow channel member inside of which is formed a flow channel for the liquid supplied to the liquid ejecting head;

a flow channel anchoring member that is manufactured using a material having a higher rigidity than at least the flow channel member and to which the flow channel member is anchored; and a head anchoring member to which multiple liquid ejecting heads are anchored in a positioned state, wherein the head anchoring member includes a housing portion that houses at least part of each of the liquid ejecting heads and an opening portion that communicates with the housing portion;

wherein the flow channel anchoring member is attached to the head anchoring member so as to span across the opening portion; and wherein each of the liquid ejecting heads is anchored to the head anchoring member to which the flow channel anchoring member is attached.

2. The liquid ejecting head unit according to claim 1, wherein the liquid ejecting heads are anchored to the head anchoring member using screws.

3. The liquid ejecting head unit according to claim 1, wherein the flow channel member is anchored to the flow channel anchoring member using screws.

4. The liquid ejecting head unit according to claim 1, wherein a wiring member for supplying signals related to liquid ejection to the liquid ejecting heads is attached to each of the liquid ejecting heads; and the flow channel anchoring member and the flow channel member each include passage openings through which the wiring members are passed.

5. A manufacturing method for a liquid ejecting head unit that includes a liquid ejecting head having a nozzle through which a liquid is ejected, a flow channel member inside of which is formed a flow channel for the liquid supplied to the liquid ejecting head, a flow channel anchoring member that is manufactured using a material having a higher rigidity than at least the flow channel member and to which the flow channel member is anchored, and a head anchoring member to which multiple liquid ejecting heads are anchored in a positioned state, the head anchoring member including a housing portion that houses at least part of each of the liquid ejecting heads and an opening portion that communicates with the housing portion, and the method comprising:

attaching the flow channel anchoring member to the head anchoring member so as to span across the opening portion; and anchoring each of the liquid ejecting heads to the head anchoring member to which the flow channel anchoring member is attached.

6. A liquid ejecting apparatus comprising a liquid ejecting head unit that includes:

a liquid ejecting head having a nozzle through which a liquid is ejected;

a flow channel member inside of which is formed a flow channel for the liquid supplied to the liquid ejecting head;

a flow channel anchoring member that is manufactured using a material having a higher rigidity than at least the flow channel member and to which the flow channel member is anchored; and a head anchoring member to which multiple liquid ejecting heads are anchored in a positioned state, wherein the head anchoring member includes a housing portion that houses at least part of each of the liquid ejecting heads and an opening portion that communicates with the housing portion;

the flow channel anchoring member is attached to the head anchoring member so as to span across the opening portion; and each of the liquid ejecting heads is anchored to the head anchoring member to which the flow channel anchoring member is attached.

* * * * *